US011548313B2

(12) United States Patent
Vadaketh et al.

(10) Patent No.: US 11,548,313 B2
(45) Date of Patent: Jan. 10, 2023

(54) LIQUID STORAGE AND RELEASE DEVICE AND PEN

(71) Applicants: CRAYOLA LLC, Easton, PA (US); BEIJING WENHAIYANG INDUSTRY & TRADING CO., LTD, Beijing (CN)

(72) Inventors: Leena Vadaketh, Easton, PA (US); Max Sze Mo Hui, Taipo (HK); Xiaomeng Luo, GuangZhou (CN); Chaoyang Jin, Beijing (CN); Haiteng Guo, Beijing (CN); Xinming Gao, CongLuoyu Town (CN)

(73) Assignee: Crayola LLC, Easton, PA (US)

( * ) Notice: Subject to any disclaimer, the term of this patent is extended or adjusted under 35 U.S.C. 154(b) by 69 days.

(21) Appl. No.: 17/044,156

(22) PCT Filed: May 23, 2019

(86) PCT No.: PCT/CN2019/088049
§ 371 (c)(1),
(2) Date: Sep. 30, 2020

(87) PCT Pub. No.: WO2019/223741
PCT Pub. Date: Nov. 28, 2019

(65) Prior Publication Data

US 2021/0122183 A1 Apr. 29, 2021

(30) Foreign Application Priority Data

May 24, 2018 (CN) ..... 201810510419.X

(51) Int. Cl.
*B43K 5/06* (2006.01)
*B43K 8/03* (2006.01)
(Continued)

(52) U.S. Cl.
CPC ..... *B43K 5/06* (2013.01); *B43K 5/10* (2013.01); *B43K 5/14* (2013.01); *B43K 8/03* (2013.01); *B43K 8/10* (2013.01)

(58) Field of Classification Search
CPC ..... B65D 1/095; B65D 31/005; B65D 37/00; B65D 81/3277; B43K 5/14; B43K 7/02; B43K 8/03; B43K 8/10
(Continued)

(56) References Cited

U.S. PATENT DOCUMENTS 3,594,091 A * 7/1971 Bleuer ..... B43K 24/08 401/107
3,987,791 A 10/1976 Chittenden et al.
(Continued)

FOREIGN PATENT DOCUMENTS

CN 2268630 Y 11/1997
CN 2317088 Y 5/1999
(Continued)

OTHER PUBLICATIONS

International Preliminary Report on Patentability received for PCT Application No. PCT/CN2019/088049, dated Dec. 3, 2020, 10 pages. (English Translation Submitted).
(Continued)

*Primary Examiner* — David P Angwin
*Assistant Examiner* — Bradley S Oliver
(74) *Attorney, Agent, or Firm* — Shook, Hardy & Bacon L.L.P.

(57) ABSTRACT

Provided are a liquid storage and release device and a pen comprising the device. The liquid storage and release device comprises a tube shell (1), a capsule-like liquid container (3), a piercing component (4) and a piston rod (5), wherein the tube shell (1) is open at one end and closed at the other end, and the interior thereof is a tube cavity (2); the
(Continued)

capsule-like liquid container (3) and/or the piercing component (4) is/are slidably arranged in the tube cavity (2); one end of the piston rod (5) is slidably arranged in the tube cavity (2) of the tube shell (1), and the other end of the piston rod (5) is provided with a liquid release opening (6); and the piston rod (5) is provided with a liquid channel through which the liquid release opening (6) is in communication with the tube cavity (2). When the piston rod (5) slides towards the interior of the tube cavity (2), the capsule-like liquid container (3) and the piercing component (4) apply pressure to each other under the action of the piston rod (5), so that the piercing component (4) pierces the capsule-like liquid container (3) so as to release the liquid pre-stored in the capsule-like liquid container (3).

14 Claims, 6 Drawing Sheets

(51) Int. Cl.
*B43K 8/10* (2006.01)
*B43K 5/10* (2006.01)
*B43K 5/14* (2006.01)

(58) Field of Classification Search
USPC ..... 401/132–135
See application file for complete search history.

(56) References Cited

U.S. PATENT DOCUMENTS 5,337,764 A * 8/1994 McKay ..... A45D 24/24 132/114
5,339,839 A * 8/1994 Forcelledo ..... A45D 24/26 132/114
5,769,553 A * 6/1998 Chaudhri ..... A46B 15/0067 401/125
6,874,967 B1 * 4/2005 Tsaur ..... B43M 11/06 401/133
7,441,973 B2 10/2008 Voegele et al.
7,549,815 B2 * 6/2009 Wong ..... B43M 11/06 401/133
8,393,816 B1 * 3/2013 Schumacher ..... B43K 8/003 401/133
3,460,235 A1 6/2013 Keller
8,550,737 B2 * 10/2013 Ruiz, Sr. ..... A61B 17/00491 401/133
8,852,231 B2 * 10/2014 Mach ..... A61B 17/0057 606/214
10,543,956 B2 * 1/2020 May ..... B65D 83/0005
2005/0111902 A1 * 5/2005 Pan ..... B65D 1/32 401/176
2009/0196675 A1 * 8/2009 May ..... B65D 47/2031 401/206
2013/0004230 A1 * 1/2013 Kirk, III ..... B05C 17/00 401/143
2015/0078801 A1 * 3/2015 Law ..... A61M 35/006 401/134

FOREIGN PATENT DOCUMENTS

CN 2422154 Y 3/2001
CN 1373469 A 10/2002
CN 101164501 A 4/2008
CN 201302048 Y 9/2009
CN 101678386 A 3/2010
CN 101720282 A 6/2010
CN 202517887 U 11/2012
CN 103287167 A 9/2013
CN 103706524 A 4/2014
CN 203724617 U 7/2014
CN 104786693 A 7/2015
CN 206151686 U 5/2017
DE 3708051 A1 9/1987
GB 2187945 B 11/1989
JP 2007-203264 A 8/2007
WO 2009/003539 A1 1/2009

OTHER PUBLICATIONS

Second Office Action and Search received for Chinese Patent Application No. 201810510419 X, dated Jan. 18, 2021, 14 pages. (English Translation Submitted).

* cited by examiner

LIQUID STORAGE AND RELEASE DEVICE AND PEN

CROSS-REFERENCE TO RELATED APPLICATIONS

This application claims priority under 35 U.S.C. § 365 to PCT/CN2019/088049, filed on May 23, 2019, entitled "LIQUID STORAGE AND RELEASE DEVICE AND PEN," which claims priority to The Chinese App. No. 201810510419.X filed on May 24, 2018, the entirety of the aforementioned applications are incorporated by reference herein.

TECHNICAL FIELD

The present invention relates to a liquid storage and release device and a pen based thereon.

BACKGROUND TECHNOLOGIES

Liquid storage and release devices are a kind of devices that can store a certain volume of liquid under normal condition and can conveniently release the liquid during use. Ink pens, tubular perfume devices and one-component glue or two-component glue or drug release devices commonly seen in daily life are typical applications of liquid storage and release devices.

Patent literatures CN200880019646 and CN201310668512 are typical representatives of two popular two-component storage and output structures. A common problem in the conventional structures of such products is that the liquid portion will be volatilized and drain and meanwhile as liquids flow and are mixed at the outlet instantaneously, it is not suitable for complex liquid mixing operation or slow release and storage. An earlier binary reaction-type mixing and output device is shown in disclosed literature CN96219763.7. It simply conceives a binary storage structure and a ball bearing release structure. However, in practice, such structures are unable to effectively mix or release liquids. Patent CN200820109821.9 discloses a liquid output device and provides a plurality of mixing and output structures and pressure structures that propel liquids to output, solving the foregoing problems to a limited extent. In practice, the foregoing disclosed technology still has shortcomings, and the liquids are unable to be output effectively or when there are reactions, the pressure generated by the liquids will push the liquids out without control. These shortcomings need to be improved and perfected and are also manifested as inconvenience when glass ampoules are used to store liquids, and the potential safety hazard from fragments of glass after breakage.

SUMMARY

To address the foregoing problem, the objective of the present invention is to provide a liquid storage and release device that can prevent drain of liquids in a storage state, and a pen based thereon.

To achieve the foregoing objective, the present invention adopts the following technical solution: a liquid storage and release device, comprising a tube shell, a capsule-like liquid container, a piercing component and a piston rod, wherein the tube shell is open at one end and closed at the other end, and the interior thereof is a tube cavity; the capsule-like liquid container and/or the piercing component is/are slidably arranged in the tube cavity; one end of the piston rod is slidably arranged in the tube cavity of the tube shell, and the other end of the piston rod is provided with a liquid release opening; the piston rod is provided with a liquid channel through which the liquid release opening is in communication with the tube cavity; and when the piston rod slides towards the interior of the tube cavity, the capsule-like liquid container and the piercing component apply pressure to each other under the action of the piston rod, so that the piercing component pierces the capsule-like liquid container so as to release the liquid pre-stored in the capsule-like liquid container.

Optionally, the piston rod adopts a hollow tube structure, the inner cavity of the hollow tube structure is a liquid channel, and the interior of the hollow tube structure is provided with a liquid absorbing material.

In the present invention, the liquid absorbing material is a material well known in the art; preferably a porous material; specifically can be polyester staple fiber.

Optionally, a rotation constraint structure that is intended to restrict relative free rotation between the piercing component and the piston rod is adopted between the piercing component and the piston rod.

Optionally, at least one end of the piercing component is provided with sharp teeth, of which tips face the capsule-like liquid container.

Optionally, there are a plurality of the capsule-like liquid containers, which are arranged in series, there is one or more piercing component, and each of the capsule-like liquid containers is opposite the sharp teeth of a corresponding piercing component.

Optionally, there are a plurality of the capsule-like liquid containers, which are arranged in parallel, the inner wall of the hollow tube structure is provided with an orifice plate in a fixed manner, which separates the inner cavity of the hollow tube structure into two cavities, the cavity adjacent to the capsule-like liquid container is a liquid mixing cavity, and the liquid absorbing material is confined in the other cavity.

Optionally, the tube shell comprises two detachable tube sections, and the capsule-like liquid container is arranged between the junction of the two tube sections and the closed end of the tube shell.

Optionally, a ridge is arranged on the inner wall of the tube shell, and a groove matched with the ridge is arranged on the piercing component.

Optionally, the piston rod adopts a hollow tube structure, the inner cavity of the hollow tube structure is a liquid channel, the inner wall of the hollow tube structure is provided with an orifice plate in a fixed manner, which separates the inner cavity of the hollow tube structure into two cavities, the cavity adjacent to the capsule-like liquid container is a first cavity, and the other is a second cavity; and the piercing component is arranged between the capsule-like liquid container and the piston rod, and a ball is arranged in the first cavity and is confined between the orifice plate and the piercing component.

Optionally, the capsule-like liquid container is made of a membrane material, which is folded face to face and then sealed on three sides by means of hot pressing, with the folded side facing the piercing component.

Optionally, the capsule-like liquid container is made of a polymer, composite polymer or aluminum foil composite polymer material.

Optionally, there are two capsule-like liquid containers, which are filled with liquids that can take chemiluminescence reaction.

Optionally, the sharp teeth are in a shape of sharp cone, with slots on the surface from the top to the bottom edge of the sharp cone.

A liquid storage and release device, comprising a tube shell, a capsule-like liquid container, a piercing component and a piston rod, wherein both ends of the tube shell are provided with openings, the opening at one end is a liquid release opening, interior of the tube shell is a tube cavity, and the capsule-like liquid container and/or the piercing component is/are slidably arranged in the tube cavity; one end of the piston rod enters the tube shell from the opening at the other end of the tube shell and is connected to the tube shell in a slidable and sealable manner; and when the piston rod slides towards the interior of the tube cavity, the capsule-like liquid container and the piercing component apply pressure to each other under the action of the piston rod, so that the piercing component pierces the capsule-like liquid container so as to release the liquid pre-stored in the capsule-like liquid container.

Optionally, a blocking component is arranged between the liquid release opening and the capsule-like liquid container.

A pen, comprising the foregoing liquid storage and release device.

Optionally, the pen further comprises a pen tube and a nib, the tube shell is located in the pen tube, the closed end of the tube shell presses against the rear end of the pen tube, an end of the piston rod containing a liquid release opening presses against the front end of the pen tube, and the rear end of the nib is inlaid in the front end of the pen tube and partially enters the liquid release opening.

Optionally, the pen tube comprises a tube body and a tube end cap, and a thread is adopted for connection between the tube end cap and the tube body.

Optionally, the front end of the pen tube is provided with a nib tube, which has a tube wall that extends to the inside of the pen tube for a section to form an annular groove between the tube wall and the inner wall of the pen tube.

A pen, comprising a liquid storage and release device, a pen tube and a nib, wherein the liquid storage and release device comprises a tube shell, a capsule-like liquid container, a piercing component and a piston rod; the tube shell is open at one end and closed at the other end, and the interior thereof is a tube cavity; the capsule-like liquid container is arranged inside the tube cavity, one end of the piston rod is arranged in the tube cavity of the tube shell in a slidable and sealable manner, the other end of the piston rod is provided with a liquid release opening and the piston rod is provided with a liquid channel through which the liquid release opening is in communication with the tube cavity; the piercing component is located inside the tube cavity, and a rotation constraint structure that is intended to restrict relative free rotation between the piercing component and the piston rod is adopted between the piercing component and the piston rod; the pen tube comprises a tube body and a tube end cap, and a thread is adopted for connection between the tube end cap and the tube body; the inner wall of the tube body is provided with a rotation constraint structure that is intended to restrict free rotation of the piston rod relative to the tube body, and the inner wall of the tube end cap is provided with a rotation constraint structure that is intended to restrict free rotation of the tube shell relative to the tube end cap.

In the present invention, the rotation constraint structure, preferably, is a rotation constraint structure provided with tooth profiles on the end face between the piercing component and the piston rod, which can coordinate and occlude with each other to achieve restriction on rotation between the two, but not to prevent the possibility of axial detachment between them.

DETAILED DESCRIPTION

Below the present invention is described in details by referring to the accompanying drawings and embodiments.

Embodiment 1

Figure 1:
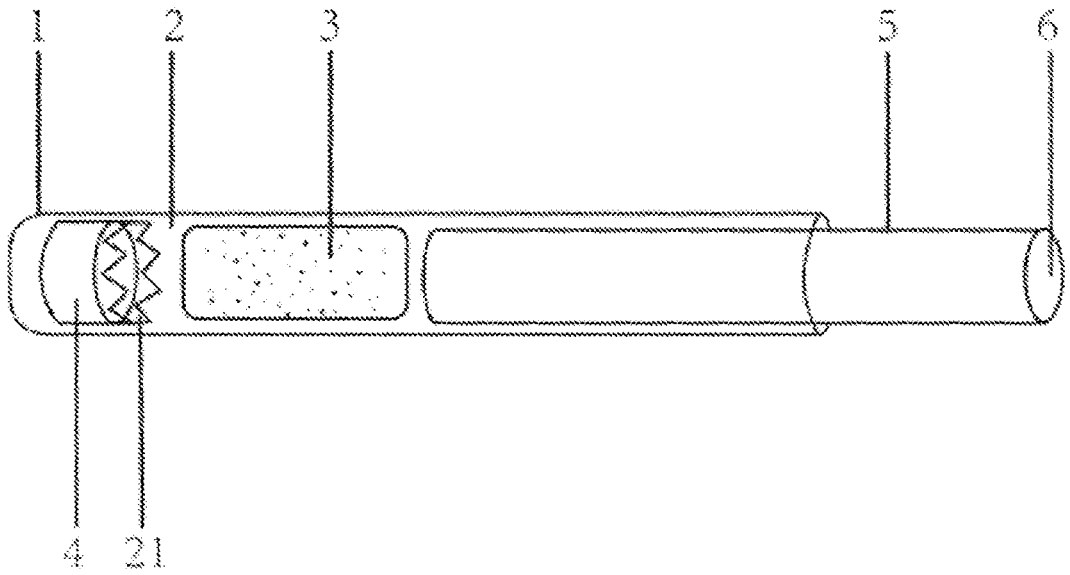
FIG. 1 is a structural schematic diagram of Embodiment 1 of the present invention.

As shown in FIG. 1, this embodiment provides a liquid storage and release device, comprising a tube shell 1, a capsule-like liquid container 3, a piercing component 4 and a piston rod 5, wherein the tube shell 1 is open at one end and closed at the other end, and the interior thereof is a tube cavity 2; the capsule-like liquid container 3 and/or the piercing component 4 is/are slidably arranged in the tube cavity 2; one end of the piston rod 5 is slidably arranged in the tube cavity 2 of the tube shell 1, and the other end of the piston rod 5 is provided with a liquid release opening 6; and the piston rod 5 is provided with a liquid channel through which the liquid release opening 6 is in communication with the tube cavity 2. When the piston rod 5 slides towards the interior of the tube cavity 2, the capsule-like liquid container 3 and the piercing component 4 apply pressure to each other under the action of the piston rod 5, so that the piercing component 4 pierces the capsule-like liquid container 3 so as to release the liquid pre-stored in the capsule-like liquid container 3. The released liquid flows out via the liquid release opening 6. The liquid storage and release device in this embodiment can store a liquid preparation in the capsule-like liquid container 3, and depending on the liquid, the device can be used to release perfume, anophelifuge, ink, one-component or two-component glue, etc. Particularly, when the liquid is wrapped and sealed in the capsule-like liquid container 3 made of aluminum foil PE/PET material, it can be stored stably for a long time, particularly suitable for liquid storage and release in a high temperature high humidity environment. For example, marker refills of volatile ink that are manufactured by this method can be stored in a harsh environment for many years, while the ink will not be dry or become ineffective.

In a preferred embodiment, a rotation constraint structure that is intended to restrict relative free rotation between the piercing component 4 and the piston rod 5 is adopted between the piercing component 4 and the piston rod 5. In this case, a user can squeeze the piston rod 5 to achieve an effect of piercing the capsule-like liquid container 3, or can rotate the piston rod 5 while squeezing the piston rod 5, thereby driving the piercing component 4 to rotate and causing the piercing component 4 to possess an effect of piercing and scratching the capsule-like liquid container 3, accelerating rupture of the capsule-like liquid container 3.

Figure 2:
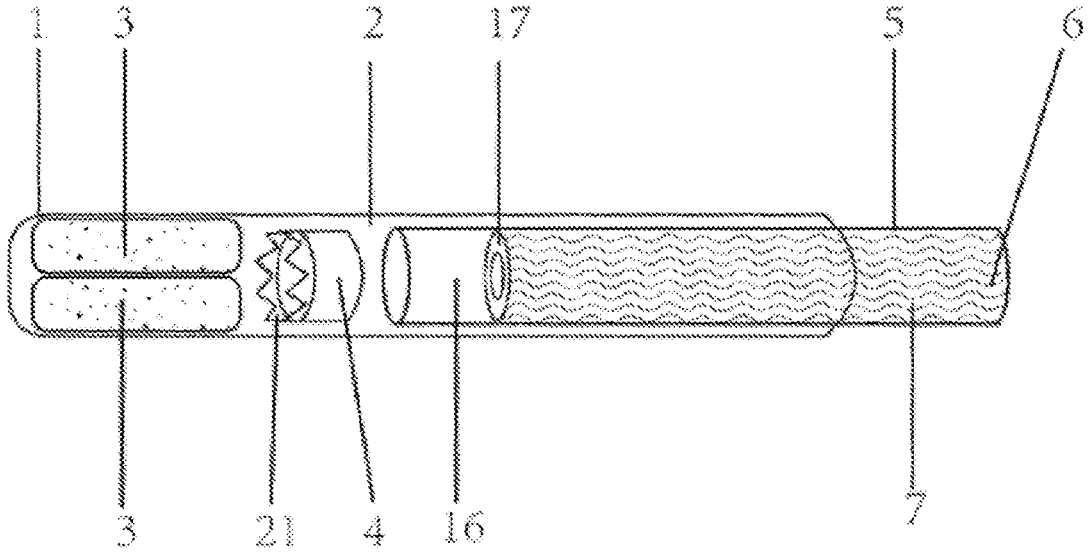
FIG. 2 is a structural schematic diagram of a liquid absorbing material provided in Embodiment 1 of the present invention.

Further, as shown in FIG. 2, the piston rod 5 adopts a hollow tube structure, the inner cavity of the hollow tube structure is a liquid channel, and the interior of the hollow tube structure is provided with a liquid absorbing material 7. The liquid absorbing material 7 stores the liquid released from the capsule-like liquid container 3 before output, so that the liquid is released in a slow and controllable manner. If a portion of liquid absorbing material is added at the liquid release opening 6 or a fiber nib is inserted into the original liquid absorbing material, a simple perfume or drug application device or a writable pen, etc. can be formed. Preferably, the liquid absorbing material 7 may adopt a tampon with wrinkled skin, which causes formation of a breather layer between the liquid absorbing material 7 and the inner wall of the hollow tube structure, thereby preventing the released liquid from being squeezed out during compression or temperature variation or by gas generated from possible reaction. Preferably, one layer of 20 um thick aluminum foil can be hot-pressed at the front end of the liquid release opening 6 as a temporary seal of the product, and meanwhile restricts the liquid absorbing material 7 from falling off.

Preferably, the piston rod 5 is connected to the inner wall of the tube shell 1 in slidable and sealable manner.

Further, the piston rod 5 can be a solid rod, too, and a guide slot is opened on the exterior wall of the solid rod as a liquid channel.

Further, the liquid absorbing material 7 adopts polyester fiber or other polymer fiber, or cotton fiber.

Further, at least one end of the piercing component 4 is provided with sharp teeth 21, of which tips face the capsule-like liquid container 3.

Figure 3:
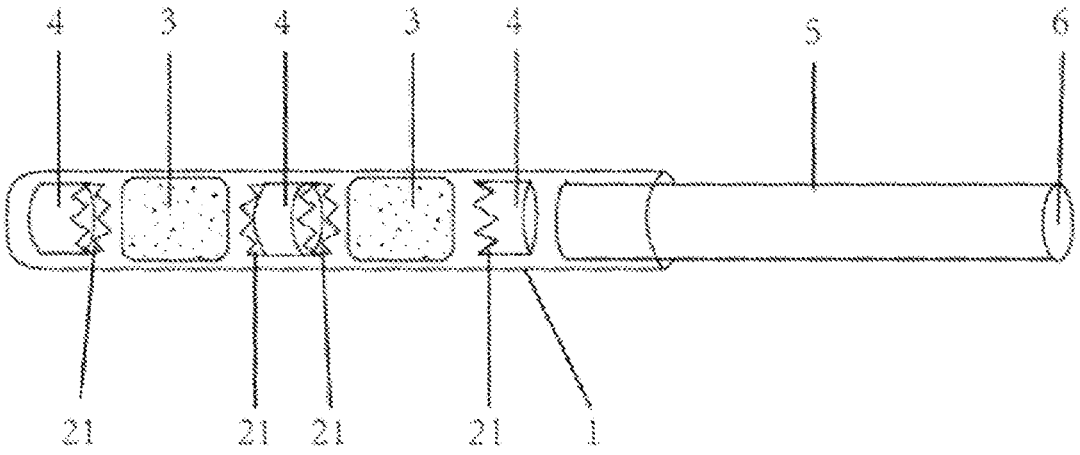
FIG. 3 is a structural schematic diagram of a plurality of capsule-like liquid containers in series adopted in Embodiment 1 of the present invention.

Further, there may one capsule-like liquid container 3, or a plurality of capsule-like liquid containers 3; when there are a plurality of capsule-like liquid containers, a form of tandem arrangement (as shown in FIG. 3), or a form of parallel arrangement (as shown in FIG. 2) can be adopted. When there are a plurality of capsule-like liquid containers 3, which are arranged in series, there is one or more piercing component 4, and each of the capsule-like liquid containers 3 is opposite the sharp teeth 21 of a corresponding piercing component 4. When there are a plurality of the capsule-like liquid containers 3, which are arranged in parallel, the piercing component 4 can be arranged on any side of the capsule-like liquid containers 3, and has two or more sharp teeth 21, and each of the capsule-like liquid containers 3 is opposite at least one sharp tooth 21.

Figure 4:
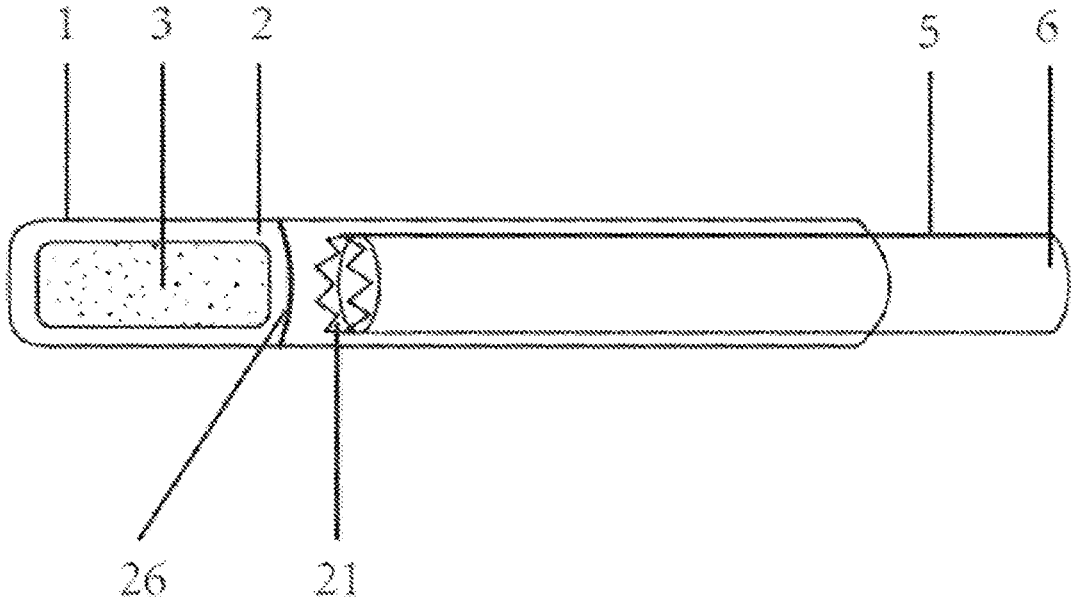
FIG. 4 is a structural schematic diagram of a tube shell adopting a detachable structure in Embodiment 1 of the present invention.

Further, when there are a plurality of capsule-like liquid containers 3, one of applications is for mixing and outputting a plurality of liquids. For example, there are two capsule-like liquid containers 3, which are filled with liquids (oxidation liquid and oxalate/fluorescent agent) that can take chemiluminescence reaction. In this case, the liquid storage and release device is a refill of a luminous pen. Now, the inner wall of the hollow tube structure is provided with an orifice plate 17 in a fixed manner, which separates the inner cavity of the hollow tube structure into two cavities, the cavity adjacent to the capsule-like liquid container 3 is a liquid mixing cavity 16, and the liquid absorbing material 7 is confined in the other cavity. The liquid mixing cavity 16 enables different liquids to be mixed as evenly as possible before the liquids are absorbed by the liquid absorbing material 7. Preferably, some silica gel particles or glass beads and other particulate matter can be put in the liquid mixing cavity 16 to not only protect the product but also improve the mixing effect or make the flowing effect more interesting. Further, as shown in FIG. 4, the tube shell 1 can comprise two detachable tube sections, and the capsule-like liquid container 3 is arranged between the junction 26 of the two tube sections and the closed end of the tube shell 1. The tube shell 1 adopts a detachable form to facilitate replacement of the used capsule-like liquid container 3.

Figure 9:
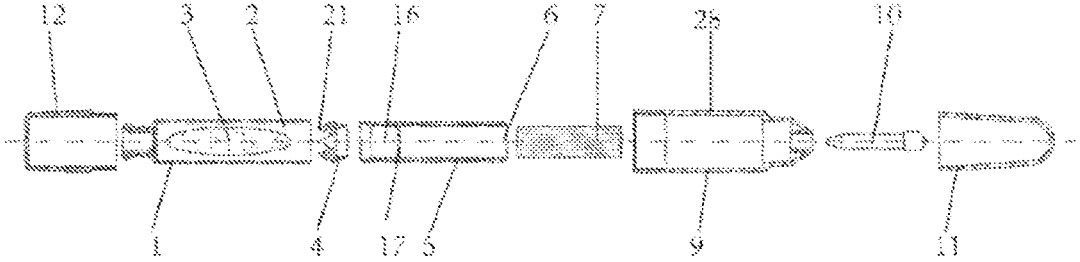
FIG. 9 is a structural schematic diagram of Embodiment 3 of the present invention.
Figure 10:
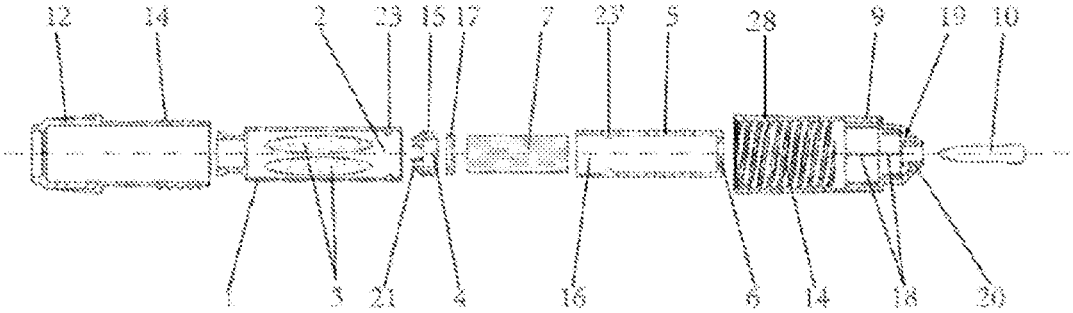
FIG. 10 is a structural schematic diagram of a plurality of capsule-like liquid containers in parallel adopted in Embodiment 3 of the present invention.
Figure 11:
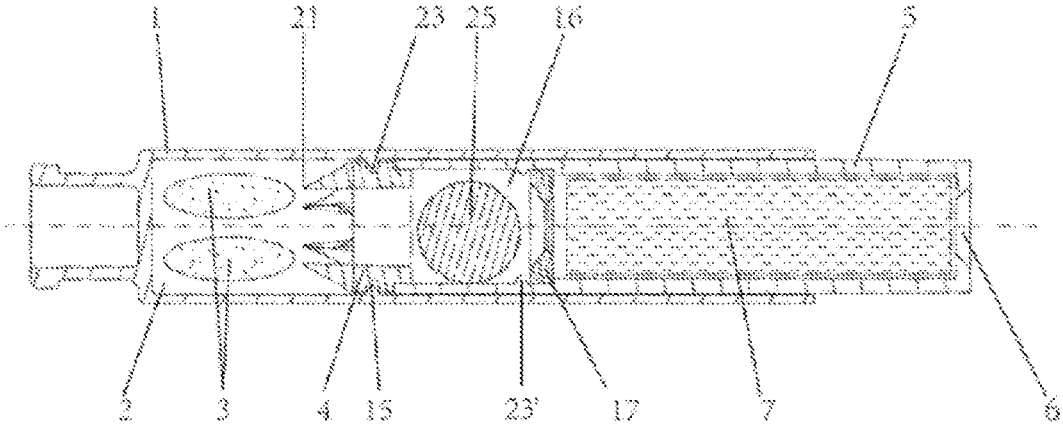
FIG. 11 is a structural schematic diagram of a replaceable refill in Embodiment 3 of the present invention.

Further, a ridge 23 is arranged on the inner wall of the tube shell 1 (as shown in FIG. 9 and FIG. 10), a groove 15 matched with the ridge 23 is arranged on the piercing component 4, and the ridge 23 is matched with the groove 15 and can form a certain degree of restriction on movement of the piercing component 4, thereby avoiding damage of the capsule-like liquid container 3 before use and meanwhile preventing the piercing component 4 from coming out from the tube shell 1. In this way, even if the user pulls out the piston rod 5, the piercing component 4 will not be brought out, resulting in puncture of the user by the sharp teeth 21. Preferably, the groove 15 may be provided with an O ring, too so that not only the groove 15 can be gently engaged with the ridge 23 but also when the piston rod 5 pushes the piercing component 4 into the tube cavity 2, the outer contour of the piercing component 4 and the inner wall of the tube cavity 2 sealably slide. It should be particularly noted that positions of the ridge 23 and the groove 15 are interchangeable, i.e.: arrange the ridge 23 on the piercing component 4, and arrange the groove 15 on the inner wall of the tube shell 1.

Further, inside the piston rod 5, there is a ridge 23', too, and after the orifice plate 17 presses against the liquid absorbing material 7, the orifice plate 17 is engaged with the ridge 23' and will not fall out.

Further, when the inner cavity of the hollow tube structure is separated into two cavities by the orifice plate 17, a ball 25 can be arranged in the cavity adjacent to the capsule-like liquid container 3 and is confined between the orifice plate 17 and the piercing component 4. The ball 25 can be solid or hollow and made of a hard material such as glass, metal or plastics. The ball 25 is equivalent to a gravity valve. When the liquid release opening 6 faces the ground, the ball 25 can block the hole of the orifice plate 17. When the liquid release opening 6 faces upwards, the ball 25 will block the hollow-out through hole of the piercing component 4. When the liquid storage and release device in this embodiment is used in a pen with a plurality of capsule-like liquid containers 3, the ball 25 can achieve a better mixing effect of a plurality of liquids. Specifically, taking a pen with two liquids being mixed for example, when the user puts the nib downwards to release two reactive liquids, the ball 25 will block the hole on the orifice plate 17 to prevent liquids not fully reacted from flowing into the liquid absorbing material 7, causing uneven subsequent output. When the user shakes the pen-holder up and down, the two liquids will be thoroughly mixed along with the shaking and meanwhile the ball 25 leaves the hole on the orifice plate 17 so that the evenly mixed liquid has a chance to pass through the orifice plate 17 and enter the tampon of the liquid absorbing material 7. In actual production, the side of the hole on the orifice plate 17 that faces the ball 25 has a certain conical chamfer to make for sealing between the hole and the ball 25.

Further, the piercing component 4 can be in a hollow ring shape, its sharp teeth 21 are distributed on the perimeter of the ring, a cross or Union Jack skeleton can be arranged inside the ring, and sharp teeth 21 can be arranged on the skeleton, too. A separate cross or Union Jack skeleton with sharp teeth 21 on it can be used as a piercing component 4. The clearance (i.e., hollow-out) between the through hole inside the ring and the cross or Union Jack skeleton can allow liquid to flow through. The sharp teeth 21 preferably are not adjacent to the inner wall of the tube cavity 2, but slightly draw close to the axis center, and meanwhile the spike direction of the sharp teeth 21 is not completely parallel with the axial direction of the tube shell 1, but should be inclined slightly to the axis. This setting is in more favor of piercing the capsule-like liquid container 3.

Figure 5:
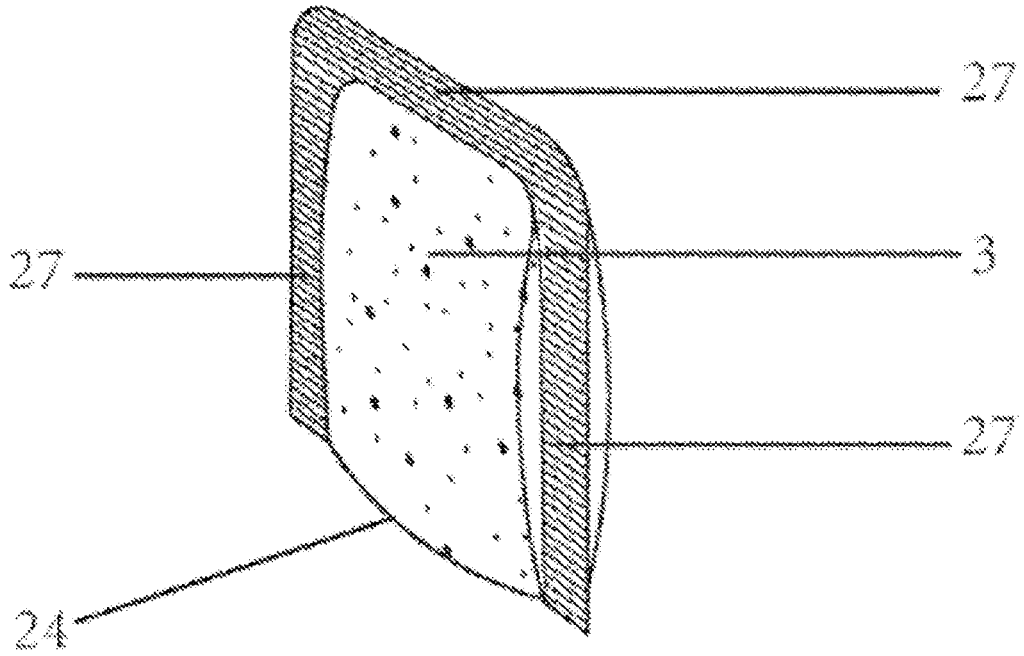
FIG. 5 is a structural schematic diagram of a capsule-like liquid container in Embodiment 1 of the present invention.
Figure 12:
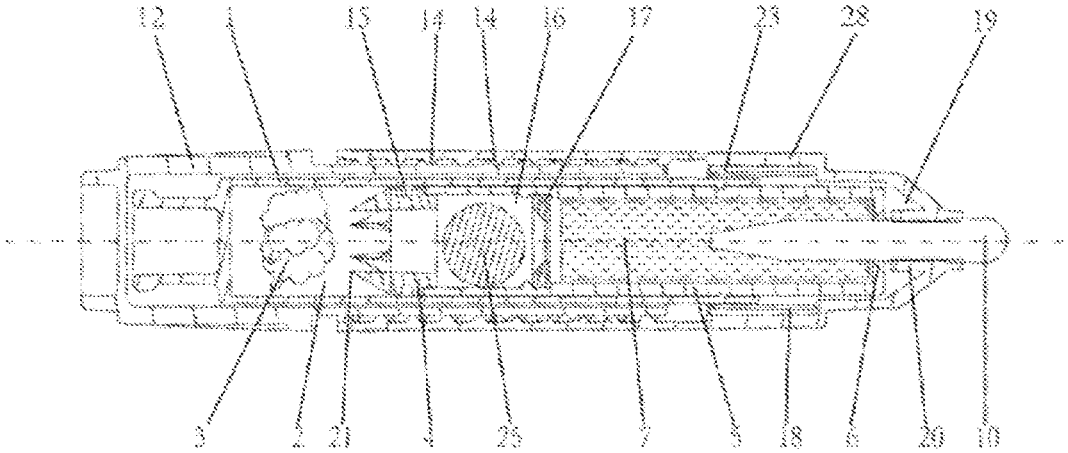
FIG. 12 is a structural schematic diagram of a replaceable refill piercing the capsule-like liquid container in Embodiment 3 of the present invention.

Further, as shown in FIG. 5, the capsule-like liquid container 3 is a liquid capsule device that is filled with sealed liquid and has a thin exterior wall. Normally, it is made of a polymer membrane material, composite polymer material or aluminum foil polymer material by means of seal welding. In numerous seal weld structures, in order to facilitate the piercing component 4 to pierce the capsule-like liquid container 3, it is found after research that the seal weld structure shown in FIG. 12, i.e., a sealing form of the capsule-like liquid container 3, should adopt a sealing form of hot-pressing three sides. In the figure, 27 shows sealing on three sides, the fourth side is formed by folding the membrane material face to face, and the end face 24 of the formed fourth side faces the sharp teeth 21 of the piercing component 4. As the end face 24 of the fourth side is not blocked by a sealed side, the piercing effect is stable.

Further, the sharp teeth 21 are in a shape of sharp cone, preferably, with slots on the surface from the top to the bottom edge of the sharp cone. The slotted sharp teeth 21 enable fast discharge of internal liquid and avoid blockage when the capsule-like liquid container 3 is pierced. The piercing component 4 can be easily obtained by means of injection molding of polymer. A preferred polymer material can be hard plastics such as polyformaldehyde, nylon or polypropylene.

Embodiment 2

Figure 6:
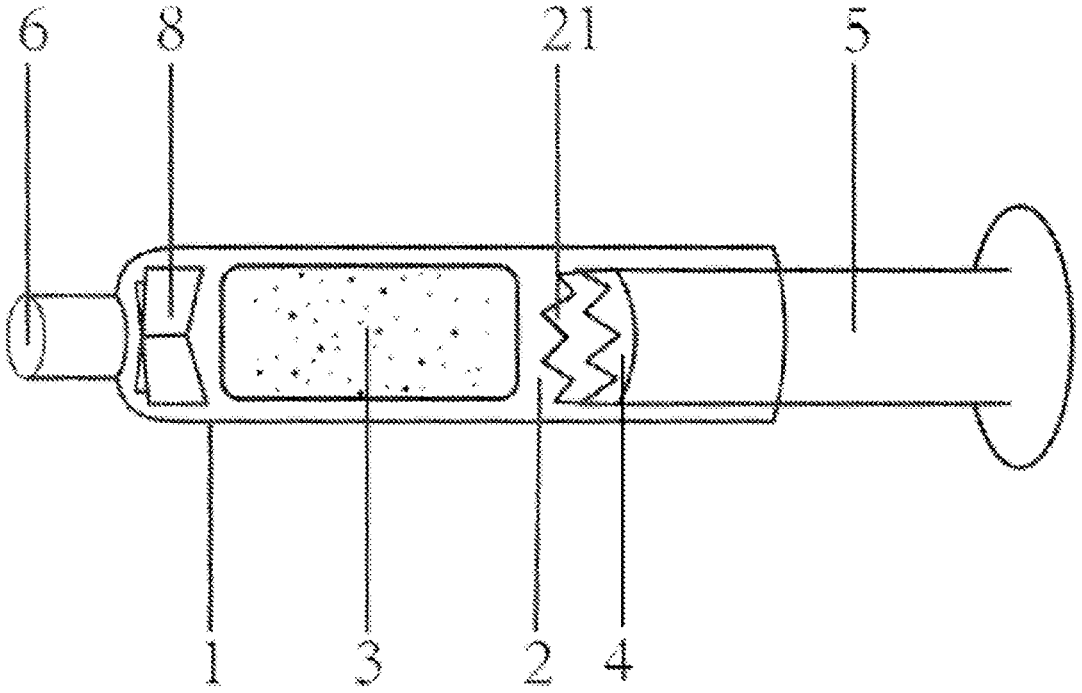
FIG. 6 is a structural schematic diagram of Embodiment 2 of the present invention.
Figure 7:
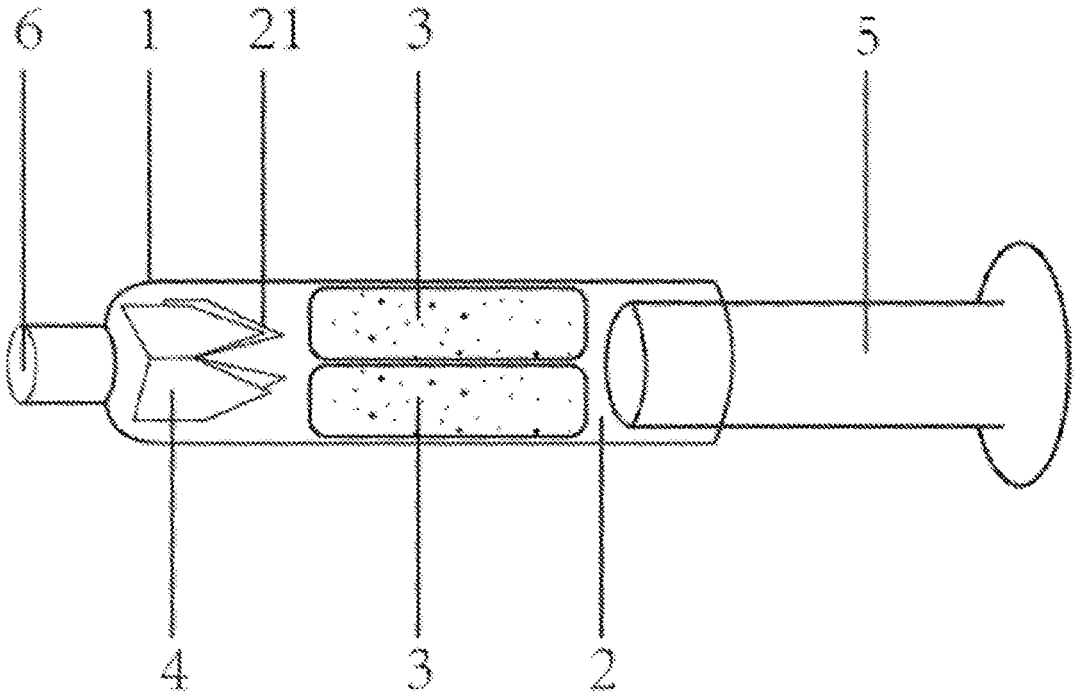
FIG. 7 is a structural schematic diagram of a plurality of capsule-like liquid containers in parallel adopted in Embodiment 2 of the present invention.
Figure 8:
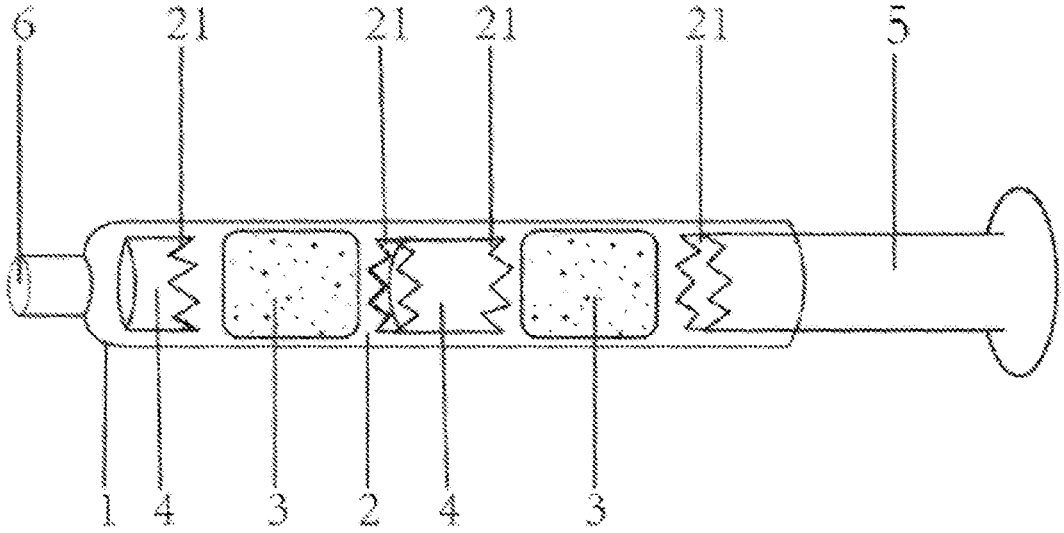
FIG. 8 is a structural schematic diagram of a plurality of capsule-like liquid containers in series adopted in Embodiment 2 of the present invention.

As shown in FIG. 6 to FIG. 8, as a difference of this embodiment from Embodiment 1, both ends of the tube shell 1 are provided with openings, the opening at one end is a liquid release opening 6, and accordingly, no liquid release opening 6 and liquid channel are arranged on the piston rod 5.

Further, a blocking component 8 is arranged between the liquid release opening 6 and the capsule-like liquid container 3, and is intended to stop the capsule-like liquid container 3 from sliding out from the liquid release opening 6 and can also prevent the capsule-like liquid container 3 from blocking the liquid release opening 6. Preferably, the blocking component 8 adopts a hollow-out structure formed by a plurality of connected convex pieces. In an alternative preferred solution, an end of the blocking component 8 facing the capsule-like liquid container 3 is provided with sharp teeth 21, the piercing component 4 in the structure can be omitted, and the blocking component containing the sharp teeth 21 is also used to pierce the capsule-like liquid container 3.

Embodiment 3

As shown in FIG. 9 to FIG. 12, based on the foregoing Embodiment 1, this embodiment provides a pen, comprising a liquid storage and release device provided in Embodiment 1.

Further, the pen further comprises a pen tube 9, a nib 10 and a pen cap 11, the tube shell 1 is located inside the pen tube 9, the closed end of the tube shell 1 presses against the rear end of the pen tube 9, an end of the piston rod 5 containing a liquid release opening 6 presses against the front end of the pen tube 9, and the rear end of the nib 10 is inlaid in the front end of the pen tube 9, partially enters the liquid release opening 6 and contacts the liquid absorbing material 7. Optionally, only one capsule-like liquid container 3 is arranged in the liquid storage and release device (as shown in FIG. 9), and in this case, the pen can be an ink pen in only one color; or two capsule-like liquid containers 3 are arranged (as shown in FIG. 10), and filled with different liquids, and in this case, the pen can be a luminous pen. For the pen described in this embodiment, the liquid storage and release device is equivalent to a replaceable refill.

Further, the pen tube 9 comprises a tube body 28 and a tube end cap 12, and a thread 14 is adopted for connection between the tube end cap 12 and the tube body 28. After the refill is installed, by rotating the tube end cap 12, the tube end cap 12 can move relative to the tube body 28, thereby compressing the piston rod 5. Under the action of the piston rod 5, the piercing component 4 pierces the capsule-like liquid container 3, thereby releasing ink. Following the further compression of the piston rod 5, the ink is absorbed by the liquid absorbing material 7. Through contact between the liquid absorbing material 7 and the nib 10, the ink is released.

Further, the front end of the pen tube 9 is provided with a nib tube 20, which has a tube wall that extends to the inside of the pen tube for a section to form an annular groove 19 between the tube wall and the inner wall of the pen tube 9. During use, the annular groove 19 can accommodate a small amount of ink that and not fully absorbed by the liquid absorbing material 7 and flows out from the liquid absorbing material 7, thereby avoiding ink directly flowing to the outside of the pen tube 9 along the nib. This design can solve the problem that the chemiluminescent liquid in reactions is liable to overflowing.

Further, a ridge 18 is arranged on the front inner wall of the pen tube 9 and used to locate the piston rod 5, and on the other hand also plays a role in venting.

FIG. 10 is a developed view of parts of a luminous pen, wherein two capsule-like liquid containers 3 seal reactable chemiluminescent liquids. In this luminous pen, there are two capsule-like liquid containers 3 in parallel inside the tube cavity 2 of the tube shell 1 with one end closed, the capsule-like liquid containers 3 is made of aluminum foil combined with PE and BOPP on the two sides respectively, the thickness is PE30 um/A110 um/BOPP28 um, and the two capsule-like liquid containers 3 are filled with chemiluminescent oxidation liquid and oxalate/fluorescent agent solution respectively, each 2 ml. The piercing component 4 has 4 to 6 sharp teeth 21, which face the capsule-like liquid container 3, a groove 15 is arranged along the peripheral margin of the piercing component 4, and a ridge 23 is arranged inside the tube cavity 2, adjacent to the opening and along the periphery of the inner wall. 7 is a liquid absorbing material, and in this embodiment, is rolling polyester staple fiber with a skin, popular in the pen making industry. One end of the piston rod 5 is a liquid release opening 6, which is a port with a shrunken hole made integrally with the piston rod 5. The port is in a size that allows the nib 10 to pass. This port may have an outward bell mouth to facilitate the importation of the nib 10 during insertion. The nib 10 is a rod-like object made of fiber or/and a porous material. The interior of the piston rod 5 is further provided with a ridge 23' along the periphery of the inner wall. The ridge 23' is intended to be engaged with the orifice plate 17 to form a mixing cavity 16. The interior of the tube body 28 of the pen tube 9 has internal threads, and the ridge 18 is intended to fix the inserted front end of the piston rod 5 and also plays a role in venting. A nib tube 20 is arranged in the cavity at one end of the tube body 28 where the nib 10 is intercalated. The nib tube 20 is a short tube extending inwardly around the nib 10. The exterior wall of the nib tube 20 and the inner wall of the tube body 28 form an annular groove 19. External threads are arranged on the pen end cap 12 and can coordinate with the internal threads on the tube body 28 and be fastened. In the foregoing structure, the tube shell 1, the piston rod 5 and the pen tube 9 all can be made of transparent resin materials, and during use, the process of release, mixing and luminescence of two chemiluminescent liquids can be observed. It is very interesting.

Embodiment 4

This embodiment provides a pen, comprising a liquid storage and release device, a pen tube 9 and a nib 10. The liquid storage and release device comprises a tube shell 1, a capsule-like liquid container 3, a piercing component 4 and a piston rod 5; the tube shell 1 is open at one end and closed at the other end, and the interior thereof is a tube cavity 2; the capsule-like liquid container 3 is arranged inside the tube cavity 2, one end of the piston rod 5 is arranged in the tube cavity 2 of the tube shell 1 in a slidable and sealable manner, the other end of the piston rod 5 is provided with a liquid release opening 6 and the piston rod 5 is provided with a liquid channel through which the liquid release opening 6 is in communication with the tube cavity 2; the piercing component 4 is located inside the tube cavity 2, and a rotation constraint structure that is intended to restrict relative free rotation between the piercing component 4 and the piston rod 5 is adopted between the piercing component 4 and the piston rod 5 (preferably, tooth profiles that can coordinate and occlude with each other are arranged on the end face between the piercing component 4 and the piston rod 5 to achieve a constraint structure that restrict rotation between the two, but not to prevent the possibility of axial detachment between them). The pen tube 9 comprises a tube body 28 and a tube end cap 12, and a thread 14 is adopted for connection between the tube end cap 12 and the tube body 28; the inner wall of the tube body 28 is provided with a rotation constraint structure that is intended to restrict free rotation of the piston rod 5 relative to the tube body 28 (not shown in the figure), and the inner wall of the tube end cap 12 is provided with a rotation constraint structure that is intended to restrict free rotation of the tube shell 1 relative to the tube end cap 12 (not shown in the figure). For the pen provided in this embodiment, when the tube end cap 12 is rotated, the tube end cap 12 compresses the piston rod 5 and meanwhile, the piston rod 5 will rotate relative to the tube shell 1, thereby driving the piercing component 4 to rotate while squeezing the capsule-like liquid container 3, so as to cause the piercing component 4 to simultaneously possess effects of piercing and scratching the capsule-like liquid container 3 and accelerate rupture of the capsule-like liquid container 3.

Further, the rotation constraint structure can be a ridge or a groove. Accordingly, a groove or ridge matched with the ridge or groove needs to be arranged on the piston rod 5 and tube shell 1.

The foregoing embodiments are intended to describe the present invention only, the structures and connection modes of the components can be changed. All the identical changes and improvements made on the basis of the technical solution of the present invention shall be included in the protection scope of the present invention.

INDUSTRIAL APPLICATIONS

As the present invention adopts the foregoing technical solution, it has the following advantages: The present invention seals liquid in a capsule-like liquid container so that problems of liquid drain during storage and ineffectiveness caused by poor sealing can be solved. Further, the cooperation of a capsule-like liquid container and a piercing component in propelling a piston rod improves the provision method of output pressure. In a word, the present invention has such advantages as safe use, no leakage and low cost.

What is claimed is:

1. A liquid storage and release device comprising:

a tube shell, a capsule-like liquid container, a piercing component and a piston rod, wherein the tube shell is open at one end and closed at the other end, and the interior thereof is a tube cavity;

the capsule-like liquid container or the piercing component is slidably arranged in the tube cavity;

one end of the piston rod is slidably arranged in the tube cavity of the tube shell, and the other end of the piston rod is provided with a liquid release opening;

the piston rod comprises a liquid absorbing material extending from the liquid release opening to a fixed orifice plate, the fixed orifice plate is separated from the one end of the piston rod such that the separation forms a liquid mixing cavity of the piston rod; and when the piston rod slides towards the interior of the tube cavity, the capsule-like liquid container and the piercing component apply pressure to each other under the action of the piston rod, so that the piercing component pierces the capsule-like liquid container so as to release a liquid pre-stored in the capsule-like liquid container.

2. The liquid storage and release device according to claim 1, wherein the piston rod adopts a hollow tube structure, an inner cavity of the hollow tube structure is a liquid channel, and the interior of the hollow tube structure is provided with the liquid absorbing material.

3. The liquid storage and release device according to claim 2, wherein there are a plurality of the capsule-like liquid containers, which are arranged in parallel, an inner wall of the hollow tube structure is provided with the fixed orifice plate, which separates the inner cavity of the hollow tube structure into two cavities, the cavity adjacent to the capsule-like liquid container is the liquid mixing cavity, and the liquid absorbing material is confined in the other cavity.

4. The liquid storage and release device according to claim 3, wherein there are two capsule-like liquid containers, which are filled with liquids that can make a chemiluminescence reaction.

5. The liquid storage and release device according to claim 1, wherein a rotation constraint structure that is intended to restrict relative free rotation between the piercing component and the piston rod is adopted between the piercing component and the piston rod.

6. The liquid storage and release device according to claim 1, wherein at least one end of the piercing component is provided with sharp teeth, of which tips face the capsule-like liquid container.

7. The liquid storage and release device according to claim 6, wherein there are a plurality of the capsule-like liquid containers, which are arranged in series, there is one or more piercing component, and each of the capsule-like liquid containers is opposite the sharp teeth of a corresponding piercing component.

8. The liquid storage and release device according to claim 6, wherein the sharp teeth are in a shape of a sharp cone, with slots on a surface from a top to a bottom edge of the sharp cone.

9. The liquid storage and release device according to claim 1, wherein the tube shell comprises two detachable tube sections, and the capsule-like liquid container is arranged between a junction of the two detachable tube sections and the closed end of the tube shell.

10. The liquid storage and release device according to claim 1, wherein a ridge is arranged on an inner wall of the tube shell, and a groove matched with the ridge is arranged on the piercing component.

11. The liquid storage and release device according to claim 1, wherein the capsule-like liquid container is made of a membrane material, which is folded face to face and then sealed on three sides by means of hot pressing, with the folded side facing the piercing component.

12. The liquid storage and release device according to claim 1, wherein the capsule-like liquid container is made of a polymer, composite polymer or aluminum foil composite polymer material.

13. The liquid storage and release device according to claim 1, further comprising particulate matter disposed within the liquid mixing cavity of the piston rod.

14. The liquid storage and release device according to claim 1, further comprising a ball disposed within the liquid mixing cavity of the piston rod, wherein the ball inhibits liquid flow through the orifice plate based on a position of the liquid storage and release device.

* * * * *